US007258533B2

(12) United States Patent
Tanner et al.

(10) Patent No.: US 7,258,533 B2
(45) Date of Patent: Aug. 21, 2007

(54) METHOD AND APPARATUS FOR SCAVENGING ENERGY DURING PUMP OPERATION

(75) Inventors: Edward T. Tanner, Williamsburg, VA (US); William F. Ott, Williamsburg, VA (US)

(73) Assignee: Adaptivenergy, LLC, Hampton, VA (US)

( * ) Notice: Subject to any disclaimer, the term of this patent is extended or adjusted under 35 U.S.C. 154(b) by 182 days.

(21) Appl. No.: 11/024,930

(22) Filed: Dec. 30, 2004

(65) Prior Publication Data

US 2006/0147324 A1 Jul. 6, 2006

(51) Int. Cl.

| | |
|---|---|
| ***F04B 17/03*** | (2006.01) |
| ***F04B 7/00*** | (2006.01) |
| ***H01L 41/00*** | (2006.01) |
| ***F16K 15/16*** | (2006.01) |

(52) U.S. Cl. ..... 417/413.2; 417/505; 310/324; 310/339; 137/855

(58) Field of Classification Search ..... 417/313, 417/413.2, 505; 310/339, 324, 319; 137/855, 137/856, 857, 858

See application file for complete search history.

(56) References Cited

U.S. PATENT DOCUMENTS 2,539,535 A * 1/1951 Espenschied ..... 290/1 R
3,822,388 A * 7/1974 Martini et al. ..... 310/300

(Continued)

FOREIGN PATENT DOCUMENTS

EP 0 202 836 A1 11/1986

(Continued)

OTHER PUBLICATIONS

International Preliminary Examination Report mailed Oct. 3, 2002 in corresponding PCT Application PCT/US01/28947.

(Continued)

*Primary Examiner*—Charles G. Freay
(74) *Attorney, Agent, or Firm*—Nixon & Vanderhye, P.C.

(57) ABSTRACT

A pump comprises a body for at least partially defining a pumping chamber (28); a pump member which undergoes displacement when acting upon a fluid in the pumping chamber; and a piezoelectric element which responds to the displacement of the pump member to generate an electric current. The electric current generated by the piezoelectric element is preferably applied to a charge storage device which is coupled to the piezoelectric element. The storage device can take various forms, including but not limited to a battery (50, 150, 250), a capacitor (52, 152, 252), and a power supply for the pump (54). In one example embodiment, the pump member is a diaphragm (26) which undergoes the displacement when acting upon a fluid in the pumping chamber. In this example embodiment, the piezoelectric element responds to the displacement of the diaphragm to generate the electric current. In another example embodiment, the pump member is a valve (130, 230, 132, 232) which undergoes the displacement to allow the fluid to communicate with the pumping chamber. The valve can be an inlet valve (130, 230) for admitting the fluid into the pumping chamber, or an outlet valve (132, 232)) for discharging the fluid from the pumping chamber. The piezoelectric element responds to the displacement of the valve to generate the electric current. The piezoelectric element can be adhered to an exterior surface of the valve. Alternatively, the piezoelectric element can constitute a working portion of the valve.

39 Claims, 7 Drawing Sheets

U.S. PATENT DOCUMENTS

| | | | | | |
|---|---|---|---|---|---|
| 3,936,342 | A | | 2/1976 | Matsubara et al. | |
| 3,960,635 | A | | 6/1976 | La Roy et al. | 156/286 |
| 4,034,780 | A | | 7/1977 | Horvath | |
| 4,095,615 | A | | 6/1978 | Ramsauer | |
| 4,442,372 | A | * | 4/1984 | Roberts | 310/339 |
| 4,595,856 | A | * | 6/1986 | Glomb, Jr. | 310/339 |
| 4,859,530 | A | | 8/1989 | Roark et al. | |
| 4,939,405 | A | | 7/1990 | Okuyama et al. | |
| 5,049,421 | A | | 9/1991 | Kosh | |
| 5,084,345 | A | | 1/1992 | Manos | |
| 5,271,724 | A | | 12/1993 | van Lintel | |
| 5,338,164 | A | | 8/1994 | Sutton et al. | |
| 5,471,721 | A | | 12/1995 | Haertling | |
| 5,589,725 | A | | 12/1996 | Haertling | 310/328 |
| 5,632,841 | A | | 5/1997 | Hellbaum et al. | |
| 5,759,015 | A | | 6/1998 | Van Lintel et al. | |
| 5,801,475 | A | * | 9/1998 | Kimura | 310/319 |
| 5,816,780 | A | | 10/1998 | Bishop et al. | 417/322 |
| 5,849,125 | A | | 12/1998 | Clark | |
| 5,876,187 | A | | 3/1999 | Forster et al. | |
| 5,909,905 | A | | 6/1999 | Simpson | |
| 5,945,768 | A | | 8/1999 | Treu, Jr. | |
| 6,030,480 | A | | 2/2000 | Face, Jr. et al. | 156/160 |
| 6,033,191 | A | | 3/2000 | Kamper et al. | |
| 6,042,345 | A | | 3/2000 | Bishop et al. | |
| 6,052,300 | A | | 4/2000 | Bishop et al. | 363/131 |
| 6,060,811 | A | | 5/2000 | Fox et al. | |
| 6,071,087 | A | | 6/2000 | Jalink, Jr. et al. | |
| 6,071,088 | A | | 6/2000 | Bishop et al. | |
| 6,104,127 | A | | 8/2000 | Kameyama et al. | |
| 6,109,889 | A | | 8/2000 | Zengerle et al. | |
| 6,114,797 | A | | 9/2000 | Bishop et al. | 310/318 |
| 6,124,678 | A | | 9/2000 | Bishop et al. | 315/209 |
| 6,156,145 | A | | 12/2000 | Clark | 156/160 |
| 6,162,313 | A | | 12/2000 | Bansemir et al. | |
| 6,179,584 | B1 | | 1/2001 | Howitz et al. | |
| 6,213,735 | B1 | | 4/2001 | Henco et al. | |
| 6,227,809 | B1 | | 5/2001 | Forster et al. | |
| 6,227,824 | B1 | | 5/2001 | Stehr | |
| 6,257,293 | B1 | | 7/2001 | Face, Jr. et al. | 156/351 |
| 6,379,809 | B1 | | 4/2002 | Simpson | |
| 6,512,323 | B2 | | 1/2003 | Forck et al. | |
| 6,734,603 | B2 | | 5/2004 | Hellbaum et al. | 310/330 |
| 6,924,584 | B2 | * | 8/2005 | Buhler et al. | 310/324 |
| 7,070,674 | B2 | | 7/2006 | Kelley | 156/307 |
| 2004/0000843 | A1 | | 1/2004 | East | |
| 2004/0021398 | A1 | | 2/2004 | East | |

FOREIGN PATENT DOCUMENTS

| | | | |
|---|---|---|---|
| GB | 2 013 311 | A | 8/1979 |
| GB | 2 161 902 | A | 1/1986 |
| GB | 2 250 911 | A | 6/1992 |
| GB | 2 262 972 | A | 7/1993 |
| WO | 87/07218 | | 12/1987 |
| WO | 02/22358 | A1 | 3/2002 |

OTHER PUBLICATIONS

International Search Report mailed Jan. 24, 2002 in corresponding PCT Application PCT/US01/28947.

GB Examination Report mailed Nov. 9, 2004 in corresponding GB application No. GB0423682.4.

International Search Report and Written Opinion mailed Oct. 3, 2006 in corresponding PCT application No. PCT/US05/47357.

* cited by examiner

METHOD AND APPARATUS FOR SCAVENGING ENERGY DURING PUMP OPERATION

BACKGROUND

1. Field of the Invention

The present invention pertains to employment of a piezoelectric device to scavenge and store energy.

2. Related Art and Other Considerations

Many types of pumps have been devised for pumping fluid, such as (for example) piston pumps, diaphragm pumps, peristaltic pumps, just to name a few. These pumps have different types of actuators and moving parts, and yet have a common requirement of requiring some type of motive power for operation of the actuator. As such, the pumps entertain or host various types of motion and/or vibration.

What is needed, and an object of the present invention, is apparatus, method, and/or technique for scavenging or otherwise harnessing the mechanical motion of a pump to produce electrical power.

BRIEF SUMMARY

A pump comprises a body for at least partially defining a pumping chamber; a pump member which undergoes displacement in conjunction with pumping of a fluid in the pumping chamber; and a piezoelectric element which responds to the displacement of the pump member to generate an electric current. The electric current generated by the piezoelectric element is preferably applied to a charge storage device which is coupled to the piezoelectric element. The storage device can take various forms, including but not limited to a battery, a capacitor, and a power supply for the pump.

In one example embodiment, the pump member is a diaphragm which undergoes the displacement when acting upon a fluid in the pumping chamber. In this example embodiment, the piezoelectric element responds to the displacement of the diaphragm to generate the electric current. The piezoelectric element can be mounted or affixed to the diaphragm in various ways. For example, the piezoelectric element can be adhered to an exterior surface of the diaphragm. The piezoelectric element can take the form of a piezoceramic film applied or adhered to the exterior surface of the diaphragm.

In one example implementation, the diaphragm itself can include a piezoelectric layer which causes the displacement of the diaphragm when an electric field is applied to the piezoelectric layer. In the example implementation in which the diaphragm comprises a piezoelectric layer, the charge storage device coupled to receive the electric current generated by the piezoelectric element can be the very power supply that applies the electric field to the piezoelectric layer of the diaphragm.

One example mode of operation of a diaphragm pump involves causing displacement of a diaphragm to act upon a fluid in a pumping chamber, and using a piezoelectric element which responds to the displacement of the diaphragm to generate an electric current. The method can further include the step of using a charge storage device for storing the electric current generated by the piezoelectric element.

In another example embodiment, the pump member is a diaphragm which acts upon the fluid in the pumping chamber and which also carries a piezoelectric element in spaced apart relation. The piezoelectric element responds to displacement of the diaphragm for generating an electric current.

In yet another example embodiment, the pump member is a diaphragm which is driven for displacement but which does not act upon the fluid in the pumping chamber. The driven diaphragm is connected to or mounted upon a piezoelectric element which is held in spaced apart relation to the diaphragm. The piezoelectric element responds to displacement of the diaphragm and in so doing serves not only for generating an electric current, but also for acting upon the fluid in the pumping chamber.

In another example embodiment, an actuator (not necessarily a diaphragm) acts upon a fluid in the pumping chamber, and the pump member is a valve which undergoes the displacement to allow the fluid to communicate with the pumping chamber. The valve can be an inlet valve for admitting the fluid into the pumping chamber, or an outlet valve for discharging the fluid from the pumping chamber. The piezoelectric element responds to the displacement of the valve to generate the electric current. The piezoelectric element can be adhered to an exterior surface of the valve. Alternatively, the piezoelectric element can constitute a working portion of the valve. The piezoelectric element can be, for example, a piezoceramic film.

Although in this another example the actuator need not necessarily be a diaphragm, it can be so with (for example) the actuator including a piezoelectric layer which causes actuation of the actuator when an electric field is applied to the piezoelectric layer. The storage device which receives the electric current generated by the piezoelectric element in response to displacement of the valve can be a power supply that applies the electric field to the piezoelectric layer of the actuator.

Another example mode of operation of a pump involves causing displacement of a valve through which fluid communicates with a pumping chamber, and using a piezoelectric element which responds to the displacement of the valve to generate an electric current. The method can further include the step of using a charge storage device for storing the electric current generated by the piezoelectric element. When the valve is an inlet value, the method further comprises causing the displacement of the valve upon entry of the fluid into the pumping chamber. When the valve is an outlet value, and the method further comprises causing the displacement of the valve upon exit of the fluid from the pumping chamber.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

In the following description, for purposes of explanation and not limitation, specific details are set forth such as particular architectures, interfaces, techniques, etc. in order to provide a thorough understanding of the present invention. However, it will be apparent to those skilled in the art that the present invention may be practiced in other embodiments that depart from these specific details. In other instances, detailed descriptions of well-known devices, circuits, and methods are omitted so as not to obscure the description of the present invention with unnecessary detail.

The pumps described herein comprise a body for at least partially defining a pumping chamber; a pump member which undergoes displacement in conjunction with pumping of a fluid in the pumping chamber; and a piezoelectric element which responds to the displacement of the pump member to generate an electric current. The electric current generated by the piezoelectric element is preferably applied to a charge storage device which is coupled to the piezoelectric element. The storage device can take various forms, including but not limited to a battery, a capacitor, and a power supply for the pump.

Figure 1A:
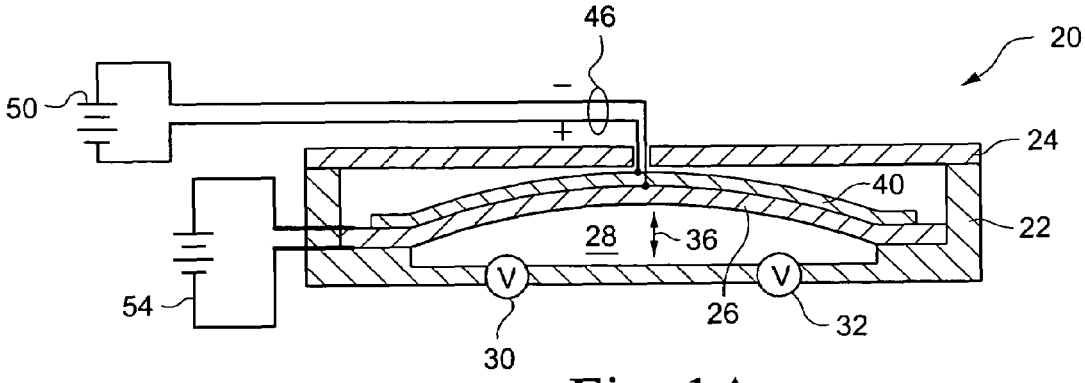
FIG. 1A and FIG. 1B are sectioned side views of an example embodiment of a pump wherein a piezoelectric element responds to displacement of a diaphragm for generating an electric current, FIG. 1A showing a displaced state of the diaphragm and FIG. 1B showing a relaxed or non-displaced state of the diaphragm.
Figure 1B:
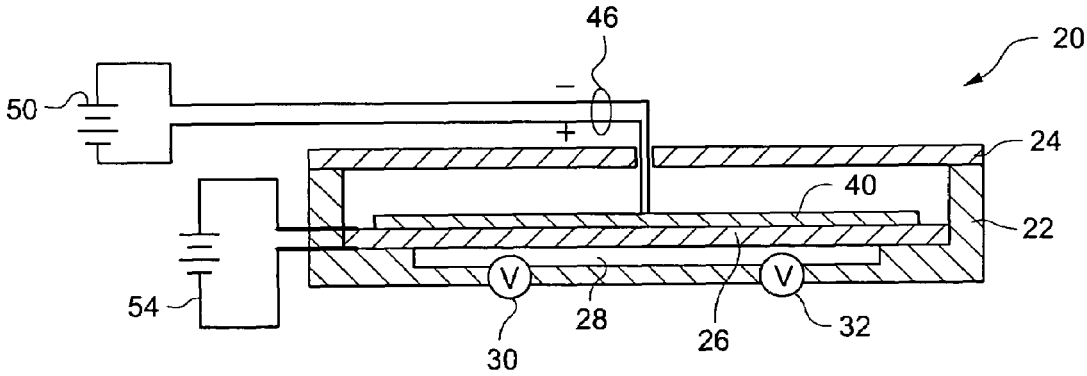

FIG. 1A and FIG. 1B show one example embodiment of such a pump. The pump 20 of FIG. 1A and FIG. 1B is described generally, and as such is meant to be representative of many different pump configurations which can host the inventive advancement described herein. Pump 20 comprises a body which includes a pump body base 22 and a pump body lid or cover 24. For the particular geometry shown in FIG. 1A and FIG. 1B, the pump body, including both its pump body base 22 and a pump body cover 24, are essentially cylindrical (e.g., circular as seen from the top). A diaphragm 26 is clamped, adhered, fastened, or welded, preferably about its periphery, to a seat or other surface of the pump body. A pumping chamber 28 is formed between diaphragm 26 and pump body base 22. The pump body, typically the pump body base 22, accommodates both an inlet valve 30 and an outlet valve 32.

In the pump 20 of FIG. 1A and FIG. 1B, the pump member which undergoes displacement is the diaphragm 26. In the FIG. 1A and FIG. 1B embodiment, the diaphragm 26 acts upon fluid in pumping chamber 28 as the diaphragm 26 undergoes its displacement. FIG. 1A shows the diaphragm 26 in its displaced state, position, or configuration during an intake or suction stroke of the pump, while FIG. 1B shows the diaphragm 26 in its relaxed (non-displaced) state during an exhaust stroke of the pump. As illustrated in FIG. 1A and understood by comparison of FIG. 1A and FIG. 1B, the displacement of the pump occurs in a direction depicted by arrow 36, i.e., in a direction orthogonal to the plane of diaphragm 26 when the diaphragm 26 is relaxed. The diaphragm 26 can be any displaceable or deformable member, and as such can comprise one or more layers of material.

Significantly, pump 20 further comprises a piezoelectric element 40 which responds to the displacement of diaphragm 26, and in so responding generates an electric current. The piezoelectric element 40 of FIG. 1 can take the form of a piezoelectric or piezoceramic film or layer which overlies or contacts an exterior surface of diaphragm 26. The piezoelectric element 40 can be mounted or affixed to the diaphragm in various ways. The piezoelectric element is preferably applied or adhered to the exterior surface of the diaphragm. In whatever form it takes, the piezoelectric element 40 is thus positioned on or over, or otherwise in contact with diaphragm 26, so that the displacement of diaphragm 26 causes a flexure, stress, or compression in piezoelectric element 40. The flexure, stress, or compression in piezoelectric element 40 causes the piezoelectric element 40 to generate an electric current which can be stored in a charge storage device.

The piezoelectric element 40 comprises a multi-layered laminate. The multi-layered laminate can comprise a piezoelectric wafer 42 which is laminated by an adhesive between an unillustrated metallic substrate layer and an unillustrated outer metal layer. The structure of the multi-layered laminate and a process for fabricating the same are described in one or more of the following (all of which are incorporated herein by reference in their entirety): PCT Patent Application PCT/US01/28947, filed 14 Sep. 2001; U.S. patent application Ser. No. 10/380,547, filed Mar. 17, 2003, entitled "Piezoelectric Actuator and Pump Using Same"; U.S. patent application Ser. No. 10/380,589, filed Mar. 17, 2003, entitled "Piezoelectric Actuator and Pump Using Same".

Figure 2:
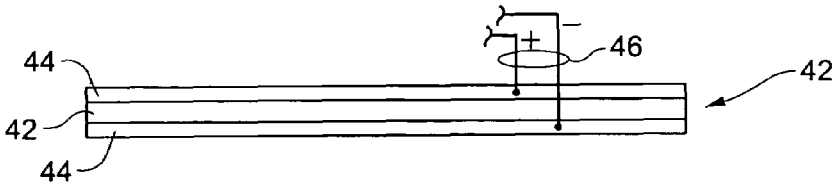
FIG. 2 is a sectioned side view of an example, non-limiting embodiment of a piezoelectric wafer which can be utilized as a displaceable, current-generating pump element.

As illustrated in FIG. 2, the piezoelectric wafer 42 which can be included in the layered laminate of piezoelectric element 40 has thin electrodes 44 sputtered or otherwise formed on its two opposing major surfaces. The electrodes 44 can be formed of Nickel or Silver, or other appropriate conductive metal. One of the electrodes 44 is a positive electrode; the other electrode 44 is a negative electrode. The positive and negative electrodes 44 are engaged by respective positive and negative leads 46.

Figure 3:
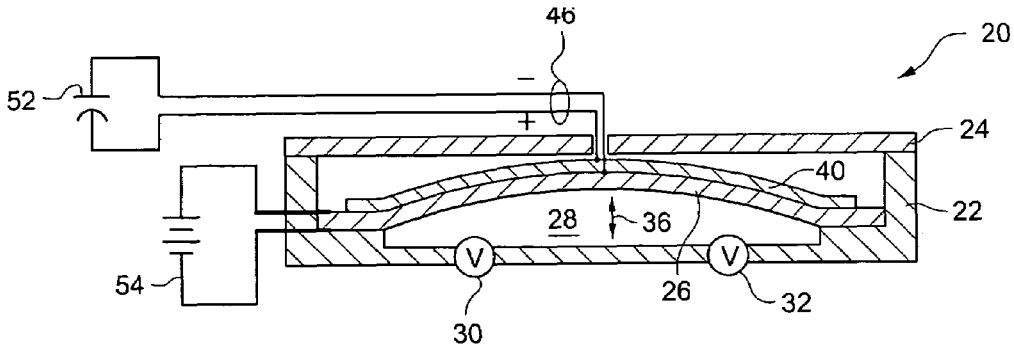
FIG. 3 is a sectioned side view showing the pump of FIG. 1A and FIG. 1B with its piezoelectric element connected by electrical leads to a capacitor rather than to a battery.

The positive and negative leads 46 are connected to an electric device such as a power supply or other charge storage device. The storage device can take various forms, including but not limited to a battery, a capacitor, and a power supply for the pump. FIG. 1A and FIG. 1B illustrate the storage device to which piezoelectric element 40 is connected by leads 46 as being a battery 50. FIG. 3 shows the pump 20 with its piezoelectric element 40 connected by leads 46 to a capacitor 52.

Figure 4:
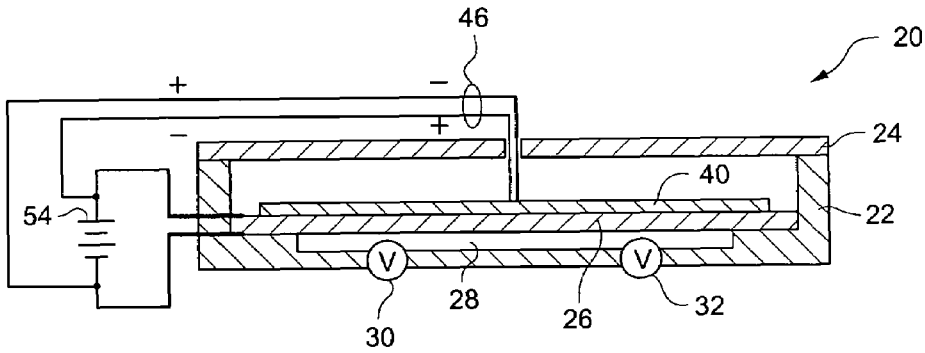
FIG. 4 is a sectioned side view showing the pump of FIG. 1A and FIG. 1B with its piezoelectric element connected by electrical leads to a power supply which applies an electric field to a diaphragm.

In one example implementation, the diaphragm 26 itself can include a piezoelectric layer, with the piezoelectric layer causing the displacement of diaphragm 26 when an electric field is applied to the piezoelectric layer. The electric field is supplied to the piezoelectric layer of diaphragm 26 by a power supply such as power supply 54 shown in FIG. 4. In the example implementation in which diaphragm 26 comprises a piezoelectric layer, the charge storage device coupled to receive the electric current generated by the piezoelectric element can be the very power supply that applies the electric field to the piezoelectric layer of diaphragm 26, i.e., power supply 54.

Figure 11A:
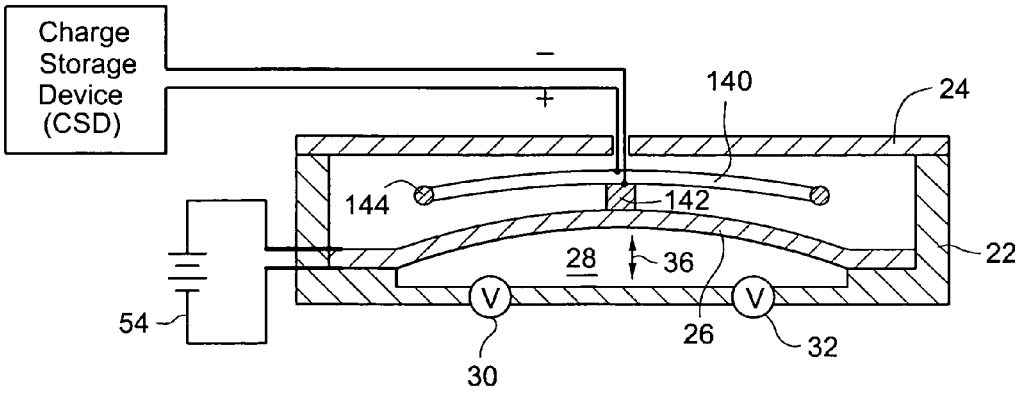
FIG. 11A and FIG. 11B are sectioned side views of an example embodiment of a pump wherein a piezoelectric element is carried in spaced apart relation by a diaphragm and responds to displacement of the diaphragm for generating an electric current, FIG. 11A showing a displaced state of the diaphragm and FIG. 11B showing a relaxed or non-displaced state of the diaphragm.
Figure 11B:
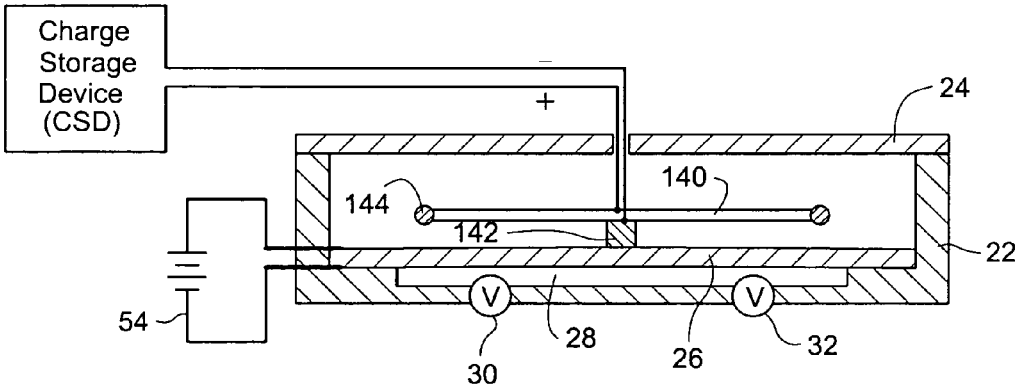

FIG. 11A and FIG. 11B are sectioned side views of another example embodiment of a pump. The pump of FIG. 11A and FIG. 11B differs from the pump of FIG. 1A and FIG. 1B in that, e.g., a piezoelectric element 140 is carried in spaced apart relation by diaphragm 26 and responds to displacement of the diaphragm 26 for generating an electric current. FIG. 11A shows a displaced state of the diaphragm for, e.g., an intake or suction stroke of the pump, while FIG. 11B shows a relaxed or non-displaced state of the diaphragm for, e.g., an exhaust stroke of the pump.

In the FIG. 11A and FIG. 11B embodiment, the piezoelectric element 140 is mounted to diaphragm 26 and is carried in spaced apart relation to diaphragm 26. The piezoelectric element 140 is preferably mounted to diaphragm 26 by a pedestal 142. Preferably the pedestal 142 mounts a center portion of the piezoelectric element physical constraint member 140 to a center portion of diaphragm 26. As shown in the example implementation of FIG. 11A and FIG. 11B, a mass 144 can be carried by the piezoelectric element 140 to accentuate motion of the piezoelectric element 140. The mass 144 can be carried at an extremity of the piezoelectric element 140. For example, in an implementation in which the piezoelectric 140 has a circular or disk-shaped configuration, the mass 144 can be carried at the periphery of the piezoelectric element 140.

As in the previously described embodiments, displacement of the driven diaphragm 26 causes a responsive displacement of the piezoelectric element 140. Specifically, the diaphragm 26 is driven to act upon the fluid in the pumping chamber, with the piezoelectric element 140 responding to the displacement of the diaphragm 26 to generate the electric current. The electric current which is stored or otherwise used by a charge storage device (e.g., battery) as generically exemplified by charge storage device CSD.

Figure 12A:
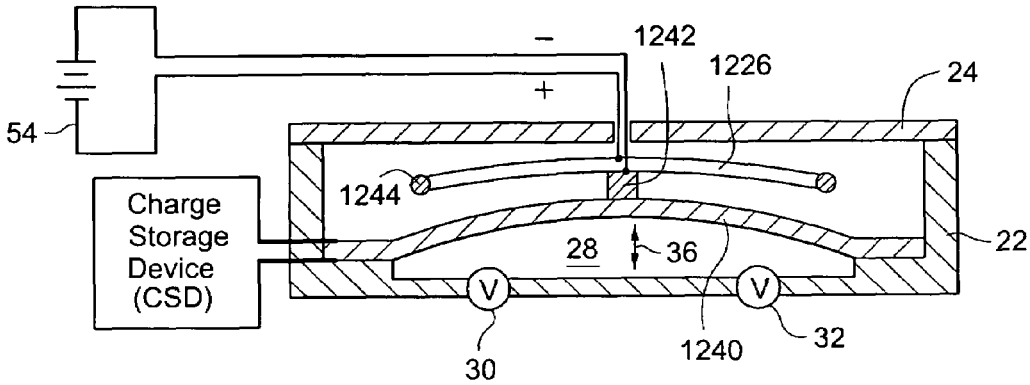
FIG. 12A and FIG. 12B are sectioned side views of an example embodiment of a pump wherein a driven diaphragm is carried in spaced apart relation by a piezoelectric element, and wherein the piezoelectric element responds to displacement of the diaphragm for working on fluid in a pumping chamber and also for generating an electric current, FIG. 12A showing a displaced state of the diaphragm and FIG. 12B showing a relaxed or non-displaced state of the diaphragm.
Figure 12B:
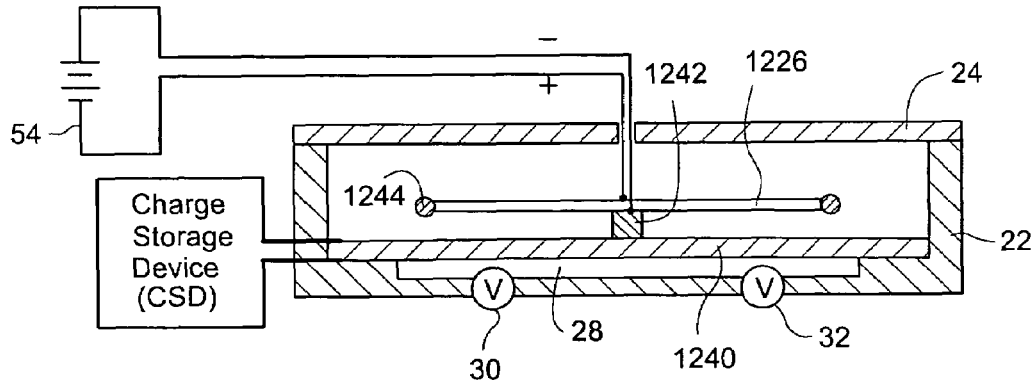

FIG. 12A and FIG. 12B are sectioned side views of an example embodiment of a pump wherein a driven diaphragm 1226 is carried in spaced apart relation by a piezoelectric element 1240, and wherein the piezoelectric element 1240 responds to displacement of the diaphragm 1226 for working on fluid in a pumping chamber 28 and also for generating an electric current. FIG. 12A shows a displaced state of the diaphragm 1226 while FIG. 12B shows a relaxed or non-displaced state of the diaphragm 1226. Thus, the embodiment of FIG. 12A and FIG. 12B differs from the embodiment of FIG. 11A and FIG. 11B in that, in FIG. 12A and FIG. 12B, the piezoelectric element 1240 rather than diaphragm 1226 acts upon the fluid in the pumping chamber 28. The diaphragm 1226 is driven by its battery or power source 54 and undergoes displacement in conjunction with the pumping of the fluid, but the pumping of the fluid is not directly accomplished by diaphragm 1226 but rather to piezoelectric element 1240 which is responsively connected to diaphragm Thus, in the embodiment of FIG. 12A and FIG. 12B, the pump member is a driven diaphragm 1226 which undergoes the displacement but which does not substantially directly act upon fluid in the pumping chamber 28. The piezoelectric element 1240 responds to the displacement of the diaphragm 1226 whereby the piezoelectric element 1240 acts upon the fluid in the pumping chamber 28 and also generates the electric current. The diaphragm 1226 is mounted to the piezoelectric element 1240 and is carried in spaced apart relation to the piezoelectric element 1240. For example, one or more pedestals 1242 may be employed to mount diaphragm 1226 to piezoelectric element 1240.

As shown in the example implementation of FIG. 12A and FIG. 12B, a mass 1244 can be carried by diaphragm 1226 to accentuate motion (e.g., displacement) of diaphragm 1226. The mass 1244 can be carried at an extremity of the diaphragm 1226. For example, in an implementation in which diaphragm 1226 has a circular or disk-shaped configuration, the mass 1244 can be carried at the periphery of diaphragm 1226.

In the embodiment of FIG. 12A and FIG. 12B, diaphragm 1226 is driven whereby the diaphragm undergoes the displacement but does not substantially directly act upon fluid in the pumping chamber 28. The piezoelectric element 1240 responds to the displacement of the diaphragm 1226, so that the piezoelectric element 1240 acts upon the fluid in the pumping chamber 28 and also generates the electric current which is stored by charge storage device CSD.

It will be appreciated that the generic charge storage devices CSD shown in the FIG. 11A and FIG. 11B embodiment, as well as in the FIG. 12A and FIG. 12B embodiment, can be any of the example charge storage devices previously discussed.

Most of the structural features of the pumps described above are merely for providing an example context for explaining how the piezoelectric elements (e.g., piezoelectric element 40; piezoelectric element 140; or piezoelectric element 240) act responsively to the displaceable diaphragm 26. As such, no particular emphasis or criticality should be assigned to any of the other structural elements of the illustrated pumps. For example, the structure and positioning of the inlet valve 30 and outlet valve 32 are not necessarily germane. The person skilled in the art will appreciate that one or more of the inlet valve 30 and outlet valve 32 can be oriented so that the direction of fluid flow through the valve(s) is parallel to the displacement direction arrow 36 (e.g., one or more of inlet valve 30 and outlet valve 32 are formed in a bottom wall of pump body base 22). Alternatively, one or more of the inlet valve 30 and outlet valve 32 can be oriented so that the direction of fluid flow through the valve(s) is perpendicular to the displacement direction arrow 36 (e.g., one or more of inlet valve 30 and outlet valve 32 is formed in a sidewall of pump body base 22).

Moreover, the shape, size, or other configuration of the pump body and its pump body base 22 and pump body lid 24 have no controlling effect or impact upon the responsive operation of piezoelectric element 40 to the displacement of diaphragm 26. Variously shaped pump bodies, with or without myriad auxiliary or surface features, could be utilized.

While the pumps described above been shown as powered by a simple power supply 54, it should be appreciated that other types of pump driving arrangements could alternatively be utilized. For example, the pumps may be governed by one or more of the driving circuits disclosed in U.S. patent application Ser. No. 10/815,978, filed Apr. 2, 2004 by Vogeley et al., entitled "Piezoelectric Devices and Methods and Circuits for Driving Same", which is incorporated herein by reference in its entirety, or by documents referenced and/or incorporated by reference therein.

Example structures of diaphragms which include a piezoelectric layer, and methods of fabricating the such diaphragms and pumps incorporating the same, as well as various example pump configurations with which the present invention is compatible, are illustrated in the following (all of which are incorporated herein by reference in their entirety): PCT Patent Application PCT/US01/28947, filed 14 Sep. 2001; U.S. patent application Ser. No. 10/380,547, filed Mar. 17, 2003, entitled "Piezoelectric Actuator and Pump Using Same"; U.S. patent application Ser. No. 10/380,589, filed Mar. 17, 2003, entitled "Piezoelectric Actuator and Pump Using Same".

Figure 5A:
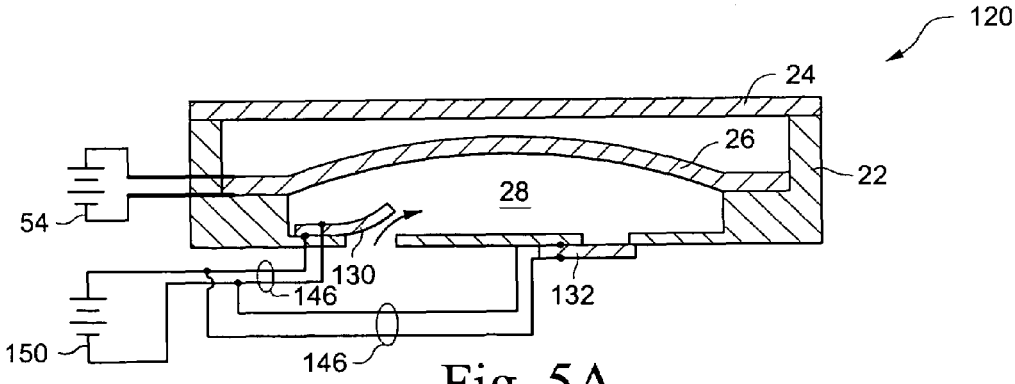
FIG. 5A and FIG. 5B are sectioned side views of an example embodiment of a pump wherein a piezoelectric element responds to displacement of a valve for generating an electric current, FIG. 5A showing a displaced state of an inlet valve and FIG. 5B showing a displaced state of an outlet valve.
Figure 5B:
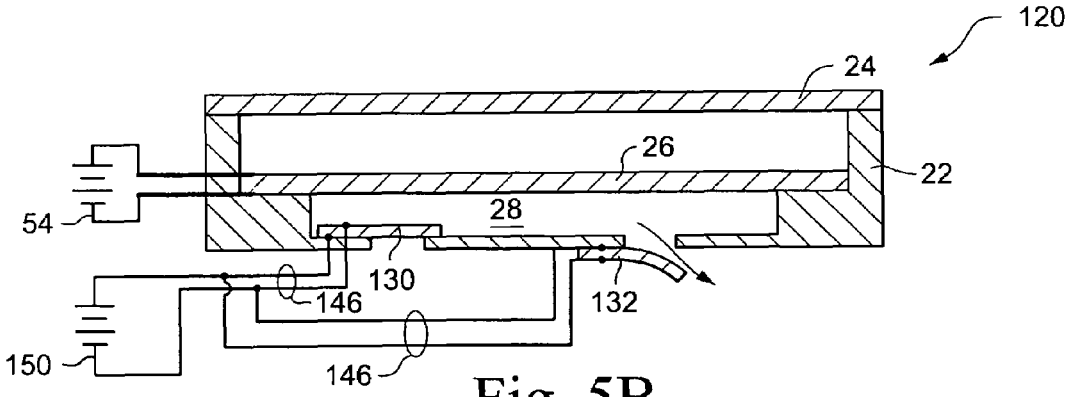

FIG. 5A and FIG. 5B show another example embodiment of a pump wherein another type of pump member undergoes displacement when acting upon a fluid in the pumping chamber. In the embodiment of FIG. 5A and FIG. 5B, the pump member which undergoes displacement and generates the electric current is a valve which undergoes the displacement to allow the fluid to communicate with the pumping chamber.

As with the previous embodiments, the pump 120 of FIG. 5A and FIG. 5B is described generally, and as such is meant to be representative of many different pump configurations which can host the inventive advancement described herein. Pump 120 comprises a body which includes a pump body base 22 and a pump body lid or cover 24. For the particular geometry shown in FIG. 5A and FIG. 5B, the pump body, including both its pump body base 22 and a pump body cover 24, are essentially cylindrical (e.g., circular as seen from the top). A pumping chamber 28 is formed in the pump body, and an actuator is provided for drawing fluid into pumping chamber 28 and pumping fluid out of pumping chamber 28. It just so happens that the form of the actuator illustrated in FIG. 5A and FIG. 5B is a diaphragm 26. However, it should be understood that, for this and subsequently described embodiments, the actuator need not be a diaphragm but could take other forms such as, for example, a piston-type actuator or even a peristaltic type actuator, for example. When the particular case that the actuator is actually a diaphragm, the diaphragm 26 can be clamped, adhered, fastened, or welded, preferably about its periphery, to a seat or other surface of the pump body.

As mentioned above, in the embodiment of FIG. 5A and FIG. 5B (as well as subsequent embodiments), the pump member which undergoes displacement and generates the electric current is a valve which undergoes the displacement to allow the fluid to communicate with the pumping chamber. For example, displaceable pump member can be one or both of an inlet valve 130 and an outlet valve 132. Functioning passively and in response to the action of the pump actuator (e.g., diaphragm 26 in the illustrated embodiment), the inlet valve 130 admits the fluid into the pumping chamber 28, whereas the outlet valve 132 discharges the fluid from the pumping chamber 28. Since either or both of the inlet valve 130 and the outlet valve 132 can serve as the displaceable, current-generating pump member, generic reference hereinafter to a "valve" can refer to one or both the inlet valve 130 and outlet valve 132.

In the embodiment of FIG. 5A and FIG. 5B, the displaceable, current-generating valve (e.g., either inlet valve 130 or outlet valve 132) is a deformable or flexible member which itself is a piezoelectric member (e.g., piezoceramic film). That is, the piezoelectric element can constitute a working portion of the valve. The piezoelectric member comprising the valve preferably has electrodes sputtered or otherwise formed on its opposing major surfaces, in like manner as illustrated with respect to piezoelectric wafer 42 in FIG. 2. When the valve flexes or moves in passive response to fluid either entering or exiting the pumping chamber 28, an electric current is generated in the piezoelectric valve member. FIG. 5A shows inlet valve 130 being flexed in response to actuation of the diaphragm 26 for drawing fluid into pumping chamber 28; FIG. 5B shows movement of outlet valve 132 in response to the actuation of diaphragm 26 for expelling fluid from pumping chamber 28. In either case, the electric current generated by the piezoelectric member of the valve is transmitted over leads 146 to a charge storage device. In the particularly illustrated embodiment of FIG. 5A and FIG. 5B, the charge storage device is a battery 150.

Figure 6:
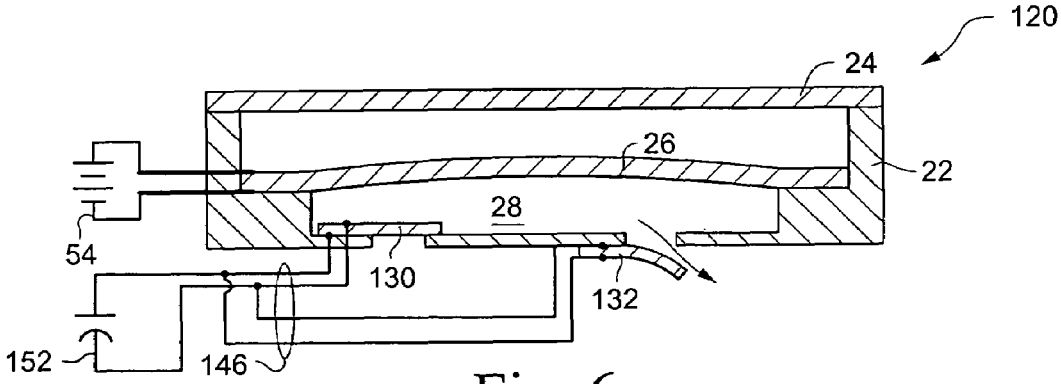
FIG. 6 is a sectioned side view showing the pump of FIG. 5A and FIG. 5B with its piezoelectric element connected by electrical leads to a capacitor rather than to a battery.
Figure 7:
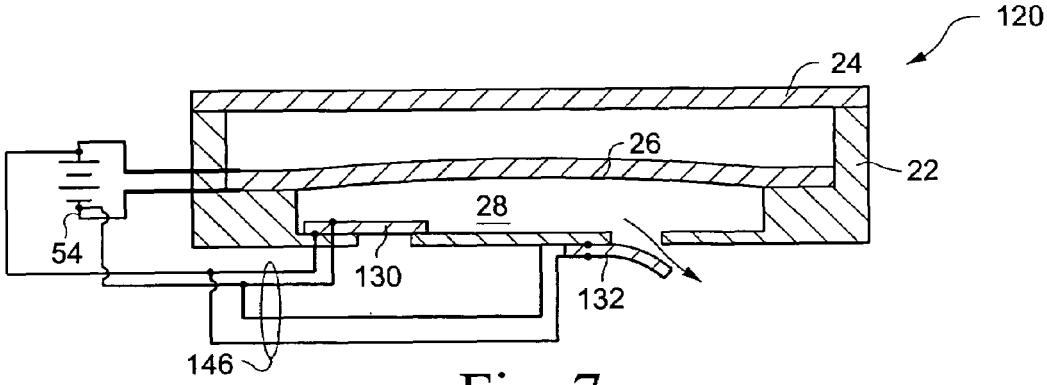
FIG. 7 is a sectioned side view showing the pump of FIG. 5A and FIG. 5B with its piezoelectric element connected by electrical leads to a power supply which applies an electric field to a diaphragm.

It will again be appreciated that the type of charge storage device can vary. For example, FIG. 6 shows the pump 120 of the FIG. 5A and FIG. 5B embodiment which supplies the charge recovered from the displaceable, current-generating valve to a capacitance 152. Alternatively, FIG. 7 shows the pump 120 of the FIG. 5A and FIG. 5B embodiment which supplies the charge recovered from the displaceable, current-generating valve to a power supply 54 which serves to actuate the actuator (e.g., diaphragm 26).

Figure 8A:
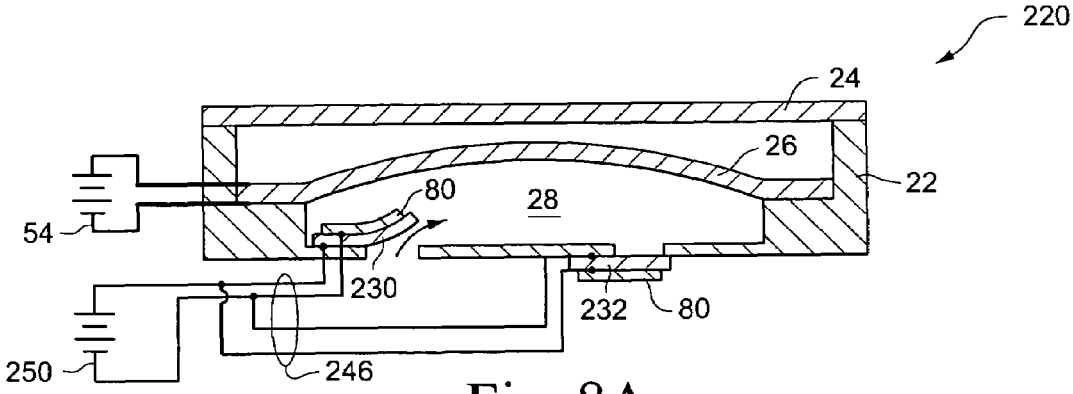
FIG. 8A and FIG. 8B are sectioned side views of an example embodiment of a pump wherein a piezoelectric element borne by a valve responds to displacement of the valve for generating an electric current, FIG. 5A showing a displaced state of an inlet valve and FIG. 5B showing a displaced state of an outlet valve.
Figure 8B:
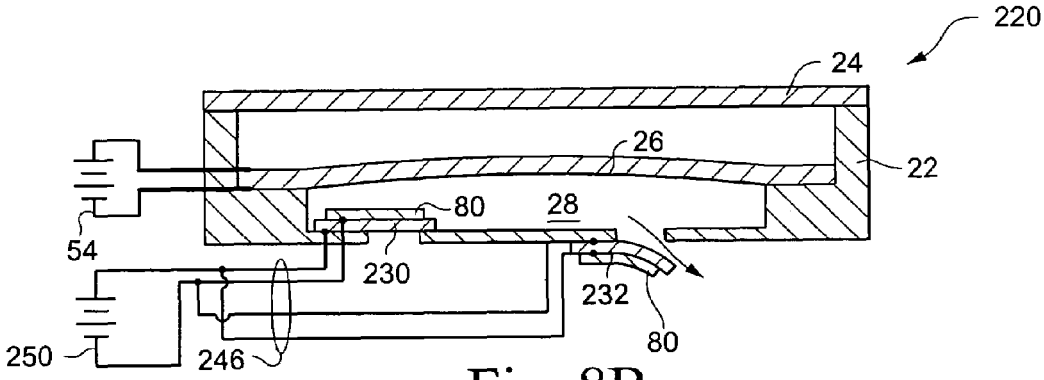
Figure 9:
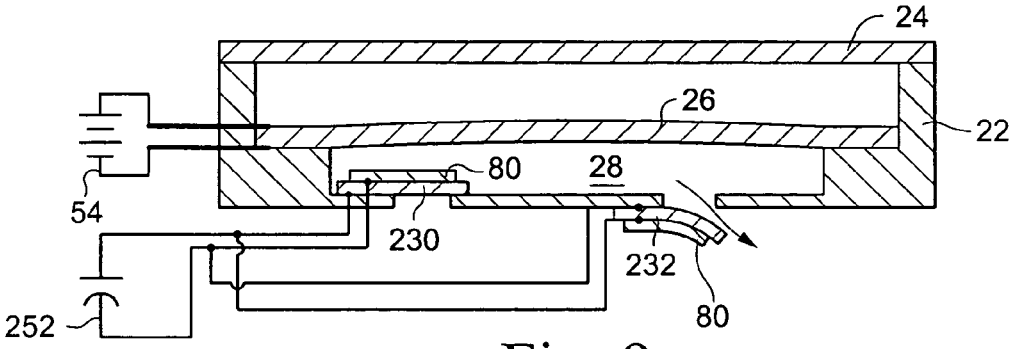
FIG. 9 is a sectioned side view showing the pump of FIG. 8A and FIG. 8B with its piezoelectric element connected by electrical leads to a capacitor rather than to a battery.
Figure 10:
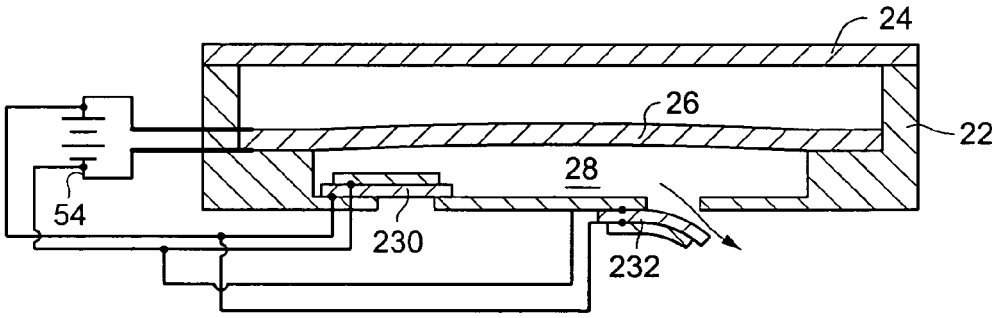
FIG. 10 is a sectioned side view showing the pump of FIG. 8A and FIG. 8B with its piezoelectric element connected by electrical leads to a power supply which applies an electric field to a diaphragm.

Rather than forming the working part of the valve itself, the piezoelectric element can be adhered to an exterior surface of the working part of the valve. For example, FIG. 8A and FIG. 8B show an embodiment of a pump 220 wherein one or both of inlet valve 230 and outlet valve 232 have a piezoceramic film 80 adhered or applied to one of the surfaces of the flexible valve. The piezoceramic film 80 can be formed with two electrodes, such as the sputtered electrodes illustrated for piezoelectric element 42 in FIG. 2. The electrodes of the piezoceramic film 80 borne by the valve are connected by leads 246 to the charge storage device. In the particularly illustrated embodiment of FIG. 8A and FIG. 8B, the charge storage device is a battery 250. In like manner as with the previous embodiments, it will be appreciated that the embodiment of FIG. 8A and FIG. 8B can instead be connected to a capacitor such as capacitor 252 as the charge storage device (see FIG. 9), or that the current generated by the piezoceramic film 80 borne by the valve can be applied to the power source 54 which actuates the actuator (e.g., diaphragm 26) of the pump.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pump comprising:

a body for at least partially defining a pumping chamber;

a diaphragm configured to undergo displacement in conjunction with pumping of a fluid through the pumping chamber;

a piezoelectric element configured to respond to the displacement of the diaphragm to generate an electric current; and a pedestal configured to mount the piezoelectric element to the diaphragm and to carry the piezoelectric element in spaced apart relation to the diaphragm.

2. The pump of claim 1, further comprising a mass carried by the piezoelectric element to accentuate motion of the piezoelectric element.

3. The pump of claim 2, wherein the piezoelectric element carries a mass proximate an extremity of the piezoelectric element.

4. The pump of claim 1, further comprising a storage device coupled to receive the electric current generated by the piezoelectric element.

5. The pump of claim 4, wherein the storage device is a battery.

6. The pump of claim 4, wherein the storage device is a capacitor.

7. A pump comprising:

a body for at least partially defining a pumping chamber;

a driven diaphragm configured to undergo displacement in conjunction with pumping of a fluid through the pumping chamber but which does not substantially directly act upon fluid in the pumping chamber;

a piezoelectric element configured to respond to the displacement of the diaphragm whereby the piezoelectric element acts upon the fluid in the pumping chamber and also generates an electric current;

a pedestal configured to mount the diaphragm to the piezoelectric element and to carry the diaphragm in spaced apart relation to the piezoelectric element.

8. The pump of claim 7, further comprising a mass carried by the diaphragm to accentuate motion of the diaphragm.

9. The pump of claim 8, wherein the diaphragm carries a mass proximate an extremity of the diaphragm.

10. The pump of claim 7, further comprising a storage device coupled to receive the electric current generated by the piezoelectric element.

11. The pump of claim 10, wherein the storage device is a battery.

12. The pump of claim 10, wherein the storage device is a capacitor.

13. A pump comprising:

a body for at least partially defining a pumping chamber;

a diaphragm configured to undergo displacement in conjunction with pumping of a fluid through the pumping chamber, the diaphragm comprising a piezoelectric layer configured to cause the displacement of the diaphragm when an electric field is applied to the piezoelectric layer;

a piezoelectric element configured to respond to the displacement of the diaphragm to generate an electric current; and a charge storage device coupled to receive the electric current generated by the piezoelectric element and to augment a power supply that applies the electric field to the piezoelectric layer of the diaphragm.

14. The pump of claim 13, wherein the storage device is a battery.

15. The pump of claim 13, wherein the storage device is a capacitor.

16. A pump comprising:

a body for at least partially defining a pumping chamber;

a pump member which undergoes displacement in conjunction with pumping of a fluid through the pumping chamber;

a piezoelectric element which responds to the displacement of the pump member to generate an electric current;

an actuator which acts upon a fluid in the pumping chamber;

wherein the pump member is a valve configured to undergo the displacement to allow the fluid to communicate with the pumping chamber; and wherein the piezoelectric element is configured to respond to the displacement to generate the electric current.

17. The pump of claim 16, further comprising a storage device coupled to receive the electric current generated by the piezoelectric element.

18. The pump of claim 17, wherein the storage device is a battery.

19. The pump of claim 17, wherein the storage device is a capacitor.

20. The pump of claim 17, wherein the piezoelectric element is adhered to an exterior surface of the valve.

21. The pump of claim 16, wherein the valve comprises a piezoceramic film.

22. The pump of claim 16, wherein the actuator includes a piezoelectric layer which causes actuation of the actuator when an electric field is applied to the piezoelectric layer.

23. The pump of claim 17, wherein the storage device is a power supply that applies the electric field to the piezoelectric layer of the actuator.

24. The pump of claim 16, wherein the valve is an inlet valve for admitting the fluid into the pumping chamber.

25. The pump of claim 16, wherein the valve is an outlet valve for discharging the fluid into the pumping chamber.

26. A method of operating a diaphragm pump comprising:

causing displacement of a diaphragm in conjunction with pumping of a fluid through a pumping chamber;

using a piezoelectric element which responds to the displacement of the diaphragm to generate an electric current;

wherein the diaphragm includes a piezoelectric layer which causes the displacement of the diaphragm when an electric field is applied to the piezoelectric layer; and wherein the method comprises using the electric current generated by the piezoelectric element to augment a power supply that applies the electric field to the piezoelectric layer of the diaphragm.

27. The method of claim 26, further comprising using a storage device for storing the electric current generated by the piezoelectric element.

28. The method of claim 27, wherein the storage device is a battery.

29. The method of claim 27, wherein the storage device is a capacitor.

30. The method of claim 26, further comprising driving the diaphragm whereby the diaphragm acts upon the fluid in the pumping chamber, and wherein the piezoelectric element responds to the displacement of the diaphragm to generate the electric current.

31. The method of claim 26, further comprising:

driving the diaphragm whereby the diaphragm undergoes the displacement but which does not substantially directly act upon fluid in the pumping chamber; and using the piezoelectric element to respond to the displacement of the diaphragm whereby the piezoelectric element acts upon the fluid in the pumping chamber and also generates the electric current.

32. A method of operating a diaphragm pump comprising:

causing displacement of a valve through which fluid communicates with a pumping chamber;

using a piezoelectric element which responds to the displacement to generate an electric current.

33. The method of claim 32, wherein the pump comprises an actuator, wherein the actuator includes a piezoelectric layer which causes the displacement of the actuator when an electric field is applied to the piezoelectric layer; and wherein the method comprises using the electric current generated by the piezoelectric element to augment a power supply that applies the electric field to the piezoelectric layer of the actuator.

34. The method of claim 32, further comprising using a storage device for storing the electric current generated by the piezoelectric element.

35. The method of claim 34, wherein the storage device is a battery.

36. The method of claim 34, wherein the storage device is a capacitor.

37. The method of claim 34, wherein the storage device is a capacitor.

38. The method of claim 32, wherein the valve is an inlet value, and wherein the method further comprises causing the displacement of the valve upon entry of the fluid into the pumping chamber.

39. The method of claim 32, wherein the valve is an outlet value, and wherein the method further comprises causing the displacement of the valve upon exit of the fluid from the pumping chamber.

* * * * *